US007412740B2

(12) United States Patent
Park et al.

(10) Patent No.: US 7,412,740 B2
(45) Date of Patent: Aug. 19, 2008

(54) METHOD FOR CONTROLLING AND SENSING AN UNBALANCE CONDITION BASED ON SENSED LAUNDRY WEIGHT

(75) Inventors: Chan Woo Park, Anyang-si (KR); Suzuki Seiichiro, Seoul (KR); Chin Won Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 600 days.

(21) Appl. No.: 10/895,954

(22) Filed: Jul. 22, 2004

(65) Prior Publication Data

US 2005/0108830 A1 May 26, 2005

(30) Foreign Application Priority Data

Nov. 25, 2003 (KR) ..... 10-2003-0084228

(51) Int. Cl.
*D06F 33/02* (2006.01)
*D06F 37/20* (2006.01)

(52) U.S. Cl. ..... 8/159

(58) Field of Classification Search ..... 8/158–159; 68/12.04, 12.06, 23.1, 24
See application file for complete search history.

(56) References Cited

U.S. PATENT DOCUMENTS 4,513,464 A * 4/1985 Rettich et al. ..... 8/159
5,325,677 A * 7/1994 Payne et al. ..... 68/12.04
5,970,555 A * 10/1999 Baek et al. ..... 8/159
6,029,299 A * 2/2000 Baek et al. ..... 8/159
6,539,753 B1 * 4/2003 Ito et al. ..... 68/3 R
6,564,413 B2 * 5/2003 Braun et al. ..... 8/159
6,637,062 B2 * 10/2003 Braun et al. ..... 8/159
7,150,167 B2 * 12/2006 Tomigashi et al. ..... 68/12.04

FOREIGN PATENT DOCUMENTS

JP 2001-224889 8/2001
JP 2001-334096 12/2001

OTHER PUBLICATIONS

Korean Patent Abstract Publication No. 1002297180000, Publication Date Aug. 18,1999.

* cited by examiner

*Primary Examiner*—Joseph L Perrin
(74) *Attorney, Agent, or Firm*—Staas & Halsey LLP

(57) ABSTRACT

A washing machine and a control method thereof sensing an unbalance condition occurring during a spin-dry cycle. The washing machine includes a controller controlling a speed of a motor in accordance with a weight of laundry contained in a rotating tub, upon wrapping the laundry at an initial stage of the spin-dry cycle. A gradient of the motor speed in a laundry wrapping process is determined, depending on the weight of the laundry. Accordingly, to greatly reduce a time prior to a main spin-dry process is possible, while preventing abnormal vibrations from being generated when a rotating speed of the rotating tub reaches a speed, at which resonance occurs.

4 Claims, 8 Drawing Sheets

FIG 4

| LAUNDRY WEIGHT / SPEED MODE | LITTLE | LOW | MIDDLE | HIGH |
|---|---|---|---|---|
| FIRST SPEED MODE | 3,3 | 2,2 | 2,2 | 1,1 |
| SECOND SPEED MODE | 3,2 | 3,2 | 2,1 | 1,1 |

METHOD FOR CONTROLLING AND SENSING AN UNBALANCE CONDITION BASED ON SENSED LAUNDRY WEIGHT

CROSS-REFERENCE TO RELATED APPLICATIONS

This application claims the benefit of Korean Patent Application No. 2003-84228, filed on Nov. 25, 2003 in the Korean Intellectual Property Office, the disclosure of which is incorporated herein by reference.

BACKGROUND OF THE INVENTION

1. Field of the Invention

The present invention relates to a washing machine and a control method thereof, and, more particularly, to a washing machine and a control method thereof which senses an unbalance condition occurring during a spin-dry cycle.

2. Description of the Related Art

In conventional washing machines, an unbalance condition of a rotating tub is sensed during an operation of a motor coupled to the rotating tub to spin-dry laundry. When an unbalance condition of the rotating tub is sensed, the motor is repeatedly driven and stopped until the unbalance condition of the rotating tub is not sensed. When the unbalance condition of the rotating tub is not sensed, the motor is continuously driven so that a speed thereof reaches a predetermined spin-dry speed.

In the conventional washing machines, the sensing of the unbalance condition is performed in a state in which laundry contained in the rotating tub is wrapped on an inner peripheral surface of the rotating tub such that the laundry is in constant contact with the inner peripheral surface of the rotating tub in accordance with a rotation of the rotating tub.

However, the conventional washing machines have problems in that the wrapped state of the laundry is not uniform because the motor is driven at a constant speed to wrap the laundry without taking into consideration the weight of the laundry. When a small amount of laundry is wrapped, the driving and stopping of the motor should be repeated several times until the unbalance condition of the rotating tub is completely eliminated. However, when a large amount of laundry is wrapped, a possibility that the unbalance condition occurs is greatly reduced. In this case, abnormal vibrations and noise may be caused by even an unbalance condition of the rotating tub, which is undetectably small, when a rotating speed of the rotating tub reaches a speed, at which resonance occurs.

SUMMARY OF THE INVENTION

An aspect of the invention is to provide a washing machine and a control method thereof in which a speed of a motor to rotate a rotating tub is controlled to spin-dry laundry, based on a weight of the laundry, and to provide uniform wrapping of the laundry, thereby reducing a laundry wrapping time while preventing abnormal vibrations from being generated when the rotating speed of the rotating tub reaches a speed, at which resonance occurs.

Additional aspects and/or advantages of the invention will be set forth in part in the description which follows and, in part, will be obvious from the description, or may be learned by practice of the invention.

In accordance with one aspect, a washing machine is provided comprising: a rotating tub; a motor to rotate the rotating tub; and a controller to control a speed of the motor in accordance with a weight of laundry provided in the rotating tub, upon wrapping of the laundry in the rotating tub to spin-dry the laundry.

The controller may vary a speed gradient of the motor, while increasing the speed of the motor to a predetermined speed to sense an unbalance condition of the rotating tub.

The washing machine may further comprise a storing unit to store information about a first speed mode set, depending on the weight of the laundry, and information about a second speed mode set, depending on the information about the set first speed mode. In this case, the controller may control the motor, based on the information provided from the storing unit.

The controller may apply the first speed mode.

Alternatively, the controller may alternately apply the first and second speed modes until an unbalanced condition of the rotating tub is eliminated.

The washing machine may further comprise a speed sensor to sense the speed of the motor. In this case, the controller may sense the weight of the laundry, based on the motor speed sensed by the speed sensor.

The second speed mode may be divided into first and second sub-modes of different speed ranges, to which identical or different motor speed gradients, respectively, are applied in accordance with the weight of the laundry.

The controller may set the motor speed gradient to be sharper at a higher weight of the laundry.

In accordance with another aspect, a control method is provided for a washing machine in which laundry in a rotating tub is spin-dried in accordance with a rotation of the rotating tub by driving of a motor connected to the rotating tub, the control method comprising: sensing a weight of the laundry; and controlling a speed of the motor in accordance with the sensed weight of the laundry during the driving of the motor to sense an unbalance condition of the rotating tub.

The controlling of the speed of the motor may be performed in a first speed mode set depending on the weight of the laundry or in a second speed mode set depending on information about the set first speed mode.

The first speed mode may be applied to the controlling of the speed of the motor.

Alternatively, the first and second speed modes may be alternately applied to the controlling of the speed of the motor.

The second speed mode may be divided into first and second sub-modes of different speed ranges to which identical or different motor speed gradients, respectively, are applied in accordance with the weight of the laundry.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 4 is a table illustrating speed modes applied to the washing machine according to FIG. 1;

DETAILED DESCRIPTION OF THE PREFERRED EMBODIMENT

Figure 1:
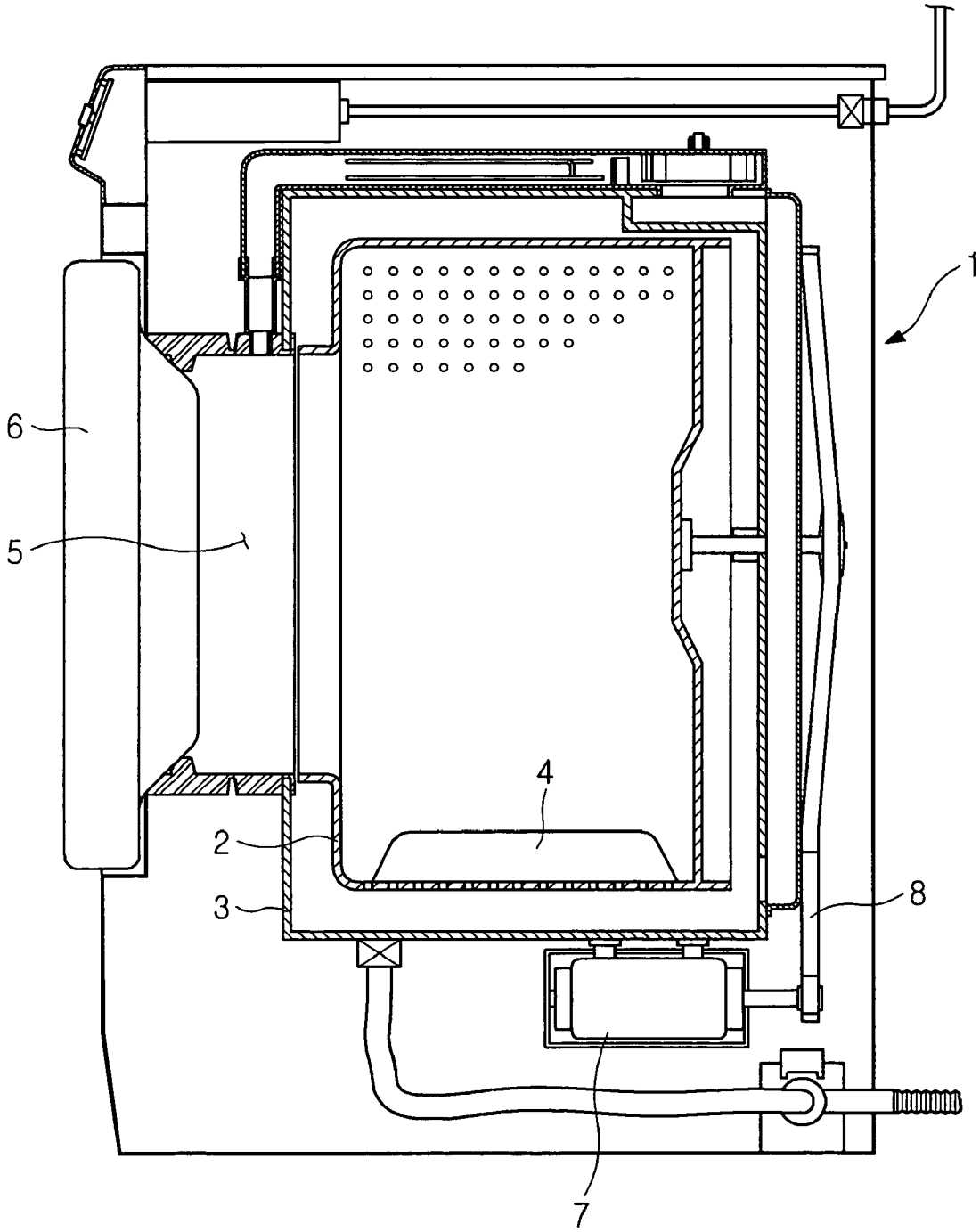
FIG. 1 is a sectional view illustrating a washing machine according to an embodiment of the present invention.

Reference will now be made in detail to the embodiment of the present invention, examples of which are illustrated in the accompanying drawings, wherein like reference numerals refer to the like elements throughout. The embodiment is described below to explain the present invention by referring to the figures.

Referring to FIG. 1, a washing machine according to an embodiment of the present invention is illustrated. As shown in FIG. 1, the washing machine includes a cabinet 1, a cylindrical drum 3 installed in the cabinet 1, a rotating tub 2 rotatably installed in the cylindrical drum 3, and provided with a plurality of lifters 4, and a motor 7 to rotate the rotating tub 2 via a belt 8. A door 6 is hingably coupled to the cabinet 1 to open and to close an opening 5 formed at a front wall of the cabinet 1.

Figure 2:
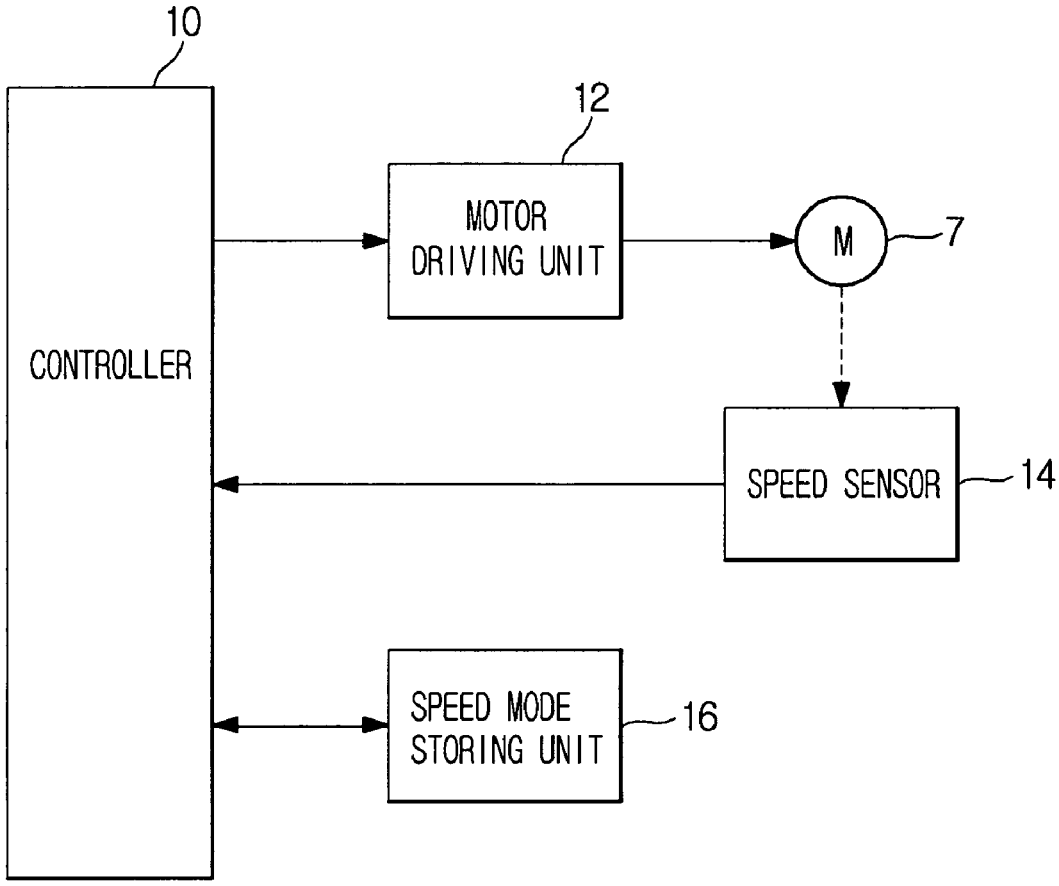
FIG. 2 is a block diagram illustrating a circuit configuration of the washing machine according to FIG. 1.

As shown in FIG. 2, the washing machine according to FIG. 1 includes a controller 10 to control an overall operation of the washing machine. The controller 10 controls the washing machine to execute a spin-dry cycle after completion of wash and rinse cycles. When the spin-dry cycle begins, the controller 10 performs an operation to sense an unbalance condition of the rotating tub 2 caused by unbalanced positioning of laundry in the rotating tub 2.

A motor driving unit 12 is connected to an output of the controller 10 to drive the motor 7 under a control of the controller 10. The motor 7 is rotatable in a clockwise or a counterclockwise direction while a speed thereof is variable. The operation of the motor 7 is controlled by the controller 10. A speed sensor 14 is connected to an input of the controller 10. The speed sensor 14 senses the speed of the motor 7, and sends an associated speed sensing signal to the controller 10. Based on the associated speed sensing signal, the controller 10 recognizes the speed of the motor 7. The speed sensor 14 may be a Hall sensor. It is noted that the motor speed corresponds to the rotating speed of the rotating tub 2.

Referring to FIG. 2, a speed mode storing unit 16 is shown which serves to provide information about speed modes to be used to determine an appropriate motor speed in accordance with a weight of the laundry upon performing a process to wrap the laundry. As shown in a table of FIG. 4, the speed mode storing unit 16 stores information about a plurality of speed modes, respectively, corresponding to diverse laundry weights.

Figure 3:
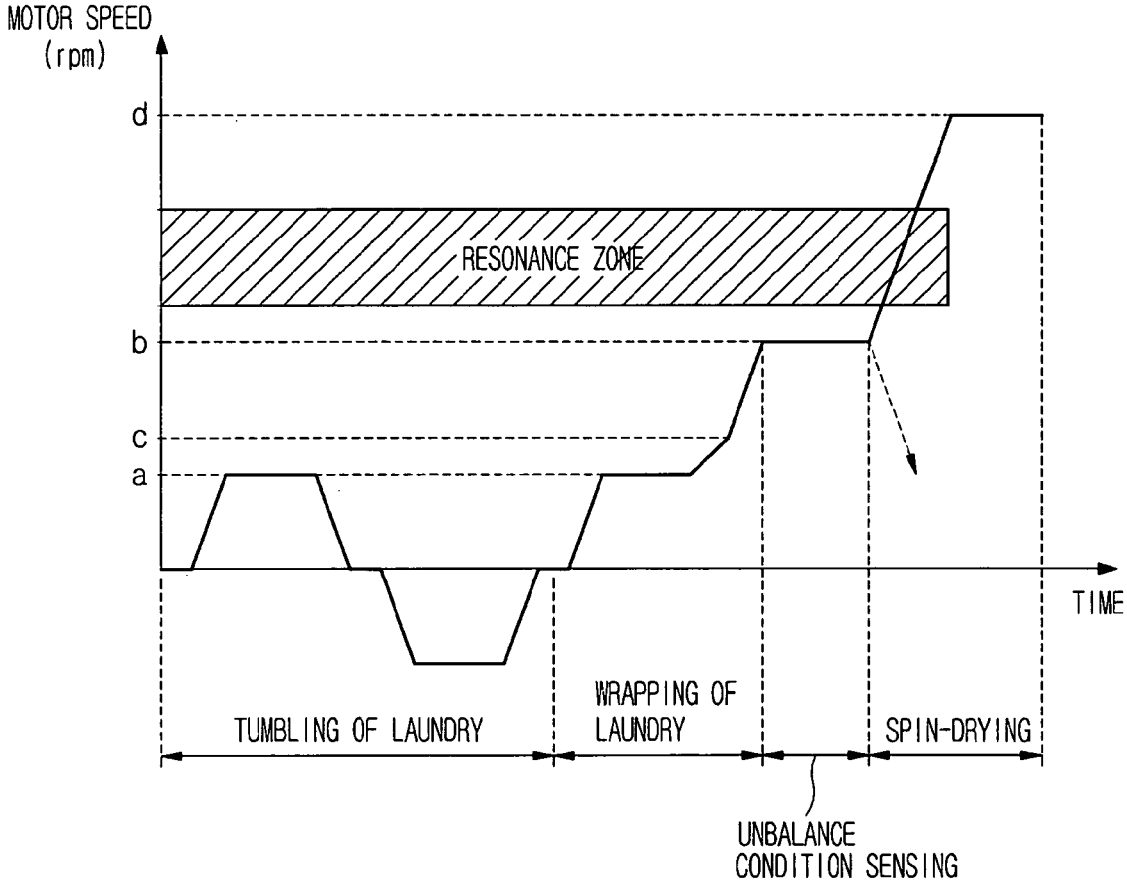
FIG. 3 is a graph depicting an operation to control a speed of a motor in a spin-dry cycle in the washing machine according to FIG. 1.

When a spin-dry cycle begins, the controller 10 senses the weight of the laundry. Thereafter, the controller 10 receives, from the speed mode storing unit 16, information about a speed mode corresponding to the sensed laundry weight, thereby controlling the speed of the motor 7. This operation will now be described in detail with reference to FIG. 3.

The controller 10 controls the motor driving unit 12 to drive the motor 7 in clockwise and counterclockwise directions in an alternate manner at a first speed a for a predetermined time such that the laundry contained in the rotating tub 2 is agitated. That is, the controller 10 performs tumbling of the laundry.

After completion of the tumbling of the laundry, the controller 10 increases the speed of the motor 7 in accordance with information about a first speed mode received from the speed mode storing unit 16, so as to perform a primary laundry wrapping process. In accordance with the first speed mode, the speed of the motor 7 is set, depending on the weight of the laundry. That is, a speed gradient of the motor 7 in the first speed mode increases as the weight of the laundry increases. For example, as shown in FIG. 4, when the weight of the laundry is large (i.e., HIGH), the speed gradient of the motor 7 is sharp (i.e., highest), as indicated by a first speed line S1 in FIG. 5. When the weight of the laundry is at a minimum (i.e., LITTLE), the speed gradient of the motor 7 is gentle (i.e., lowest), as indicated by a third speed line S3 in FIG. 5. When the weight of laundry is small at a second lowest level (i.e., LOW) or middle at a third lowest level (i.e., MIDDLE), the motor 7 has a speed gradient determined as indicated by a second speed line S2 in FIG. 5.

Figure 5:
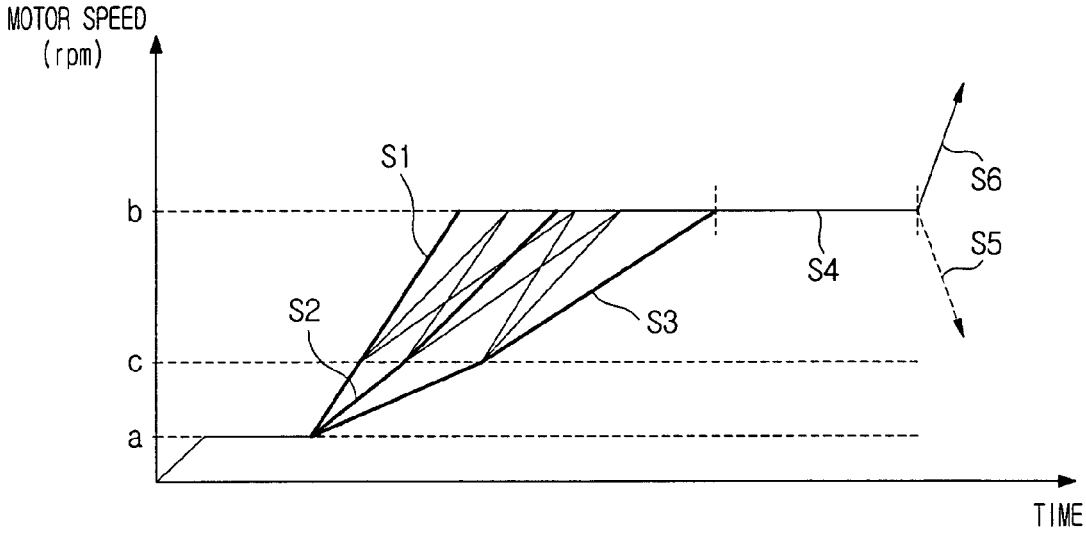
FIG. 5 is a graph depicting the speed of the motor determined in accordance with a weight of laundry in the washing machine according to FIG. 1.

When the speed of the motor 7 reaches an unbalance sensing speed b, the controller 10 senses an unbalance condition of the rotating tub 2 from a variation in the motor speed sensed through the speed sensor 14 (S4 in FIG. 5). That is, the controller 10 senses the unbalance condition of the rotating tub 2 based on the variation in the motor speed occurring when the speed of the motor 7 is set to the unbalance sensing speed b. The controller 10 recognizes the occurrence of the unbalance condition when the speed variation of the motor 7, which drives at the unbalance sensing speed b, exceeds a reference variation. The speed variation may be a difference between a maximum speed and a minimum speed.

If no unbalance condition of the rotating tub 2 is sensed after a completion of the primary laundry wrapping process in the first speed mode, the controller 10 then increases the speed of the motor 7 to a spin-dry speed d (FIG. 3), and performs, at the spin-dry speed d, a main spin-dry process to spin-dry water contained in the laundry (S6 in FIG. 5). Although the speed of the motor 7 passes a speed range corresponding to a resonance zone of the rotating tub 2 in a process of the speed increase thereof, abnormal vibrations and noise, which may be generated in the resonance zone, are considerably suppressed because the wrapping of the laundry is achieved in accordance with the weight of the laundry.

When the unbalance condition of the rotating tub 2 is sensed after the completion of the primary laundry wrapping process in the first speed mode, the controller 10 recognizes that unbalanced positioning of the laundry in the rotating tub 2 is not completed eliminated. Accordingly, the controller 10 stops the motor 7, and again performs tumbling of the laundry (S5 in FIG. 5). Thereafter, a secondary laundry wrapping process is performed. A second speed mode is applied to the secondary laundry wrapping process to control the speed of the motor 7 in a manner different from that of the first speed mode applied to the primary laundry wrapping process. That is, the first speed mode maintains a speed gradient set in accordance with the weight of the laundry while the speed of the motor 7 increases from the first speed a to the unbalance sensing speed b and the second speed mode is divided into a plurality of sub-modes corresponding to respective speed ranges to divide from a speed range defined from the first speed a to the unbalance sensing speed b. The gradient of the motor speed in each of the sub-modes is set in accordance with the weight of the laundry so that the gradient of the motor speed is identical to or different from the gradient of the motor speed of the first speed mode.

The reason the second speed mode, which is different from the first speed mode applied to the primary laundry wrapping process, is applied to the secondary laundry wrapping process is that controlling the speed of the motor 7 in the secondary laundry wrapping process is necessary, taking into a consideration an error possibly occurring in a measurement of the laundry weight performed for the primary laundry wrapping process. When the sensed laundry weight is the minimum (i.e., LITTLE), the primary laundry wrapping process is performed under a condition in which the speed of the motor 7 is controlled based on the information of the first speed mode. That is, the speed of the motor 7 is controlled in accordance with a speed line S21 in FIG. 6. When the unbalance condition of the rotating tub 2 is sensed at the unbalance sensing speed b corresponding to a speed line S41 in FIG. 6, tumbling of the laundry is again performed (S51 in FIG. 6). Subsequently, the secondary laundry wrapping process is performed. In the secondary laundry wrapping process, wrapping of the laundry is performed under a condition in which the speed of the motor 7 is controlled based on the information of the second speed mode. That is, the speed of the motor 7 is controlled in accordance with a speed line S22 in FIG. 6. The motor 7 is controlled to have a speed gradient different from the speed gradient of the first speed mode in a first speed range from a to c, as indicated by a corresponding portion of the speed line S22 while having a common speed gradient as the first speed mode in a second speed range from c to b as indicated by another corresponding portion of the speed line S22.

Figure 6:
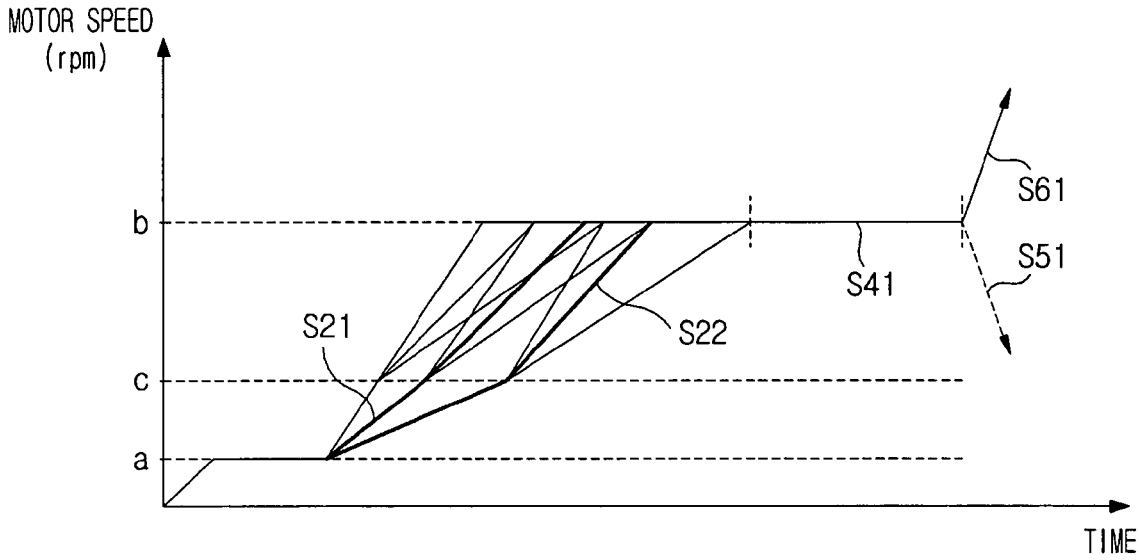
FIG. 6 is a graph depicting the speed of the motor in the washing machine according to FIG. 1, in a case in which the weight of the laundry is small.

When no unbalance condition of the rotating tub 2 is sensed after a completion of the secondary laundry wrapping process in the second speed mode, the controller 10 increases the speed of the motor 7 to the spin-dry speed d, and performs, at the spin-dry speed d, a main spin-dry process to spin-dry the water contained in the laundry (S61 in FIG. 6). Although the speed of the motor 7 passes a speed range corresponding to a resonance zone (see FIG. 3) of the rotating tub 2 in the process of the speed increase thereof, abnormal vibrations and noise, which may be generated in the resonance zone, are considerably suppressed because the wrapping of the laundry is achieved in accordance with the weight of the laundry.

When the unbalance condition of the rotating tub 2 is sensed after the completion of the secondary laundry wrapping process in the second speed mode, the controller 10 recognizes that unbalanced positioning of the laundry in the rotating tub 2 is not completely eliminated. Accordingly, the controller 10 stops the motor 7, and again performs tumbling of the laundry and an additional laundry wrapping process. In this case, the first speed mode used in the primary laundry wrapping process is applied to the additional laundry wrapping process.

Thus, wrapping of the laundry is performed until the unbalance condition of the rotating tub 2 is completely eliminated, under the condition of the first and second speed modes being alternately applied to the laundry wrapping process.

A method of controlling the washing machine having the above described configuration in accordance FIG. 1 will be described with reference to FIGS. 7A and 7B.

Figure 7A:
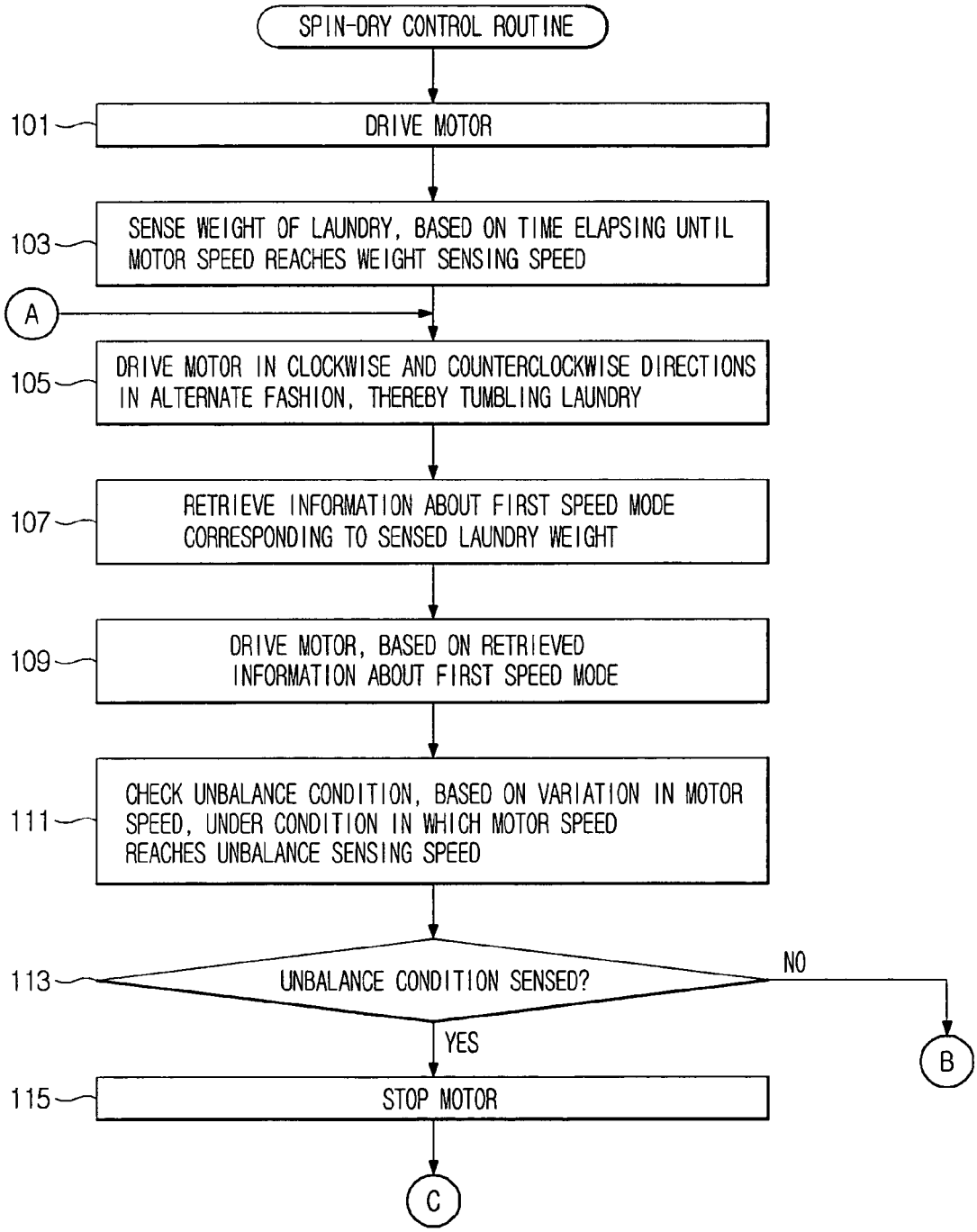
FIGS. 7A and 7B are flow charts illustrating a method of controlling the washing machine in accordance with FIG. 1.
Figure 7B:
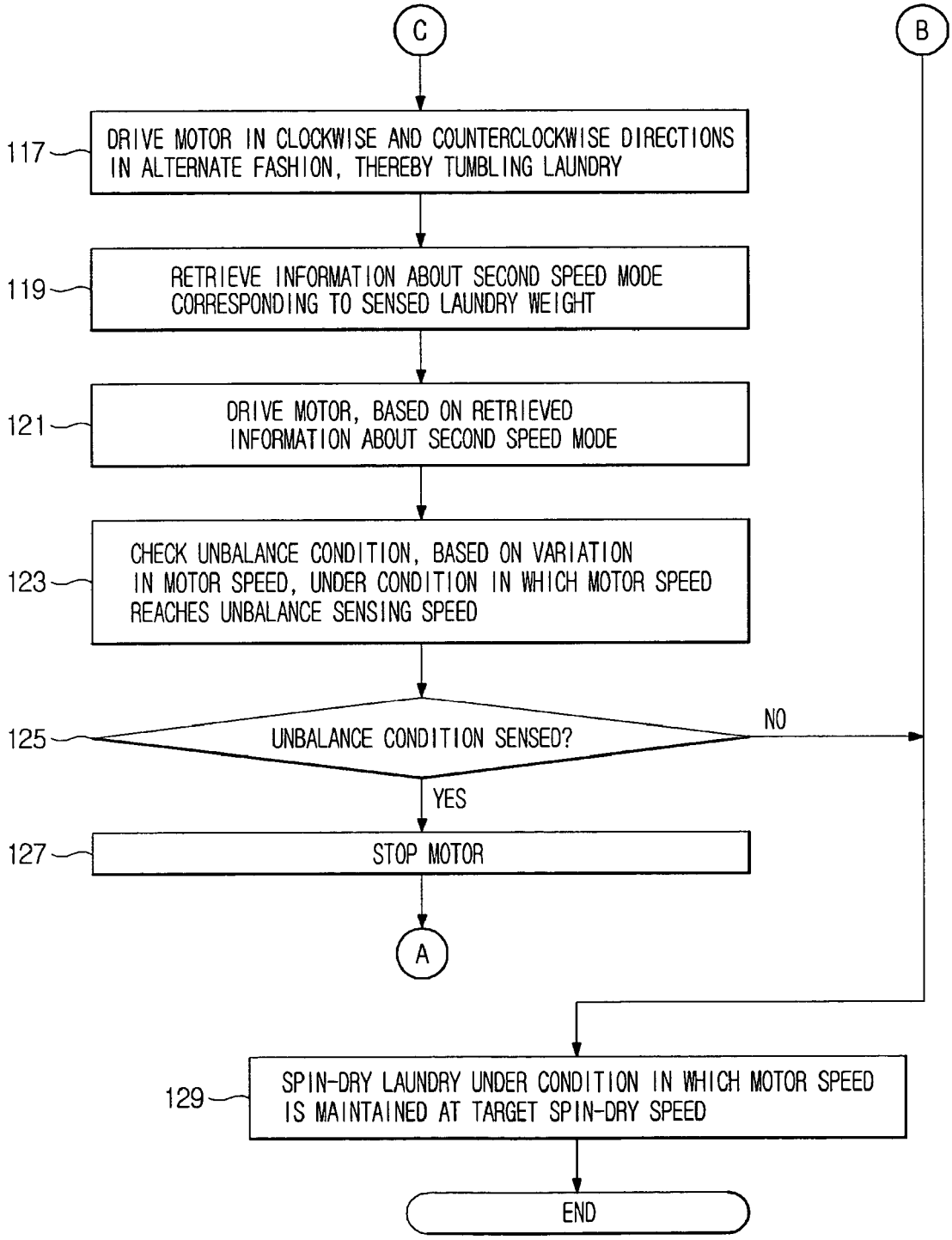

Referring to a spin-dry control routine shown in FIGS. 7A and 7B, the controller 10 controls the motor driving unit 12 at an initial stage of a spin-dry cycle to drive the motor 7 (operation 101). The controller 10 counts a time elapsing until the speed of the motor 7 sensed by the speed sensor 14 reaches a weight sensing speed of, for example, about 105 rpm, and senses the weight of the laundry based on the counted time (operation 103).

After sensing the laundry weight, the controller 10 drives the motor 7 in clockwise and counterclockwise directions in an alternate manner at the first speed a for a predetermined time, thereby performing tumbling of the laundry (operation 105). After completing the tumbling of the laundry, the controller 10 retrieves, from the speed mode storing unit 16, information about a first speed mode corresponding to the sensed laundry weight (operation 107). Based on the retrieved information about the first speed mode, the controller 10 drives the motor 7 (operation 109). In accordance with the first speed mode, the speed of the motor 7 is set, depending on the weight of the laundry. The speed gradient of the motor 7 in the first speed mode increases as the weight of the laundry increases.

The controller 10 checks whether or not the motor speed sensed by the speed sensor 14 reaches the unbalance sensing speed b. When the sensed motor speed is determined to have reached the unbalance sensing speed b, the controller 10 checks an unbalance condition of the rotating tub 2 by comparing a variation in the speed of the motor 7 with a reference speed variation (operation 111).

Based on a checked result at operation 111, the controller 10 determines whether or not the unbalance condition of the rotating tub 2 is sensed (operation 113). When no sensed unbalance condition of the rotating tub 2 is determined at operation 113, the controller 10 advances the routine to operation 129. At operation 129, the controller 10 increases the speed of the motor 7 to a target spin-dry speed d and maintains the target spin-dry speed d for a predetermined time so as to spin-dry the laundry.

When the unbalance condition of the rotating tub 2 is determined to be sensed at operation 113, the controller 10 stops the motor 7 (operation 115), and again performs tumbling of the laundry by driving the motor 7 in the clockwise and counterclockwise directions in an alternating manner at the first speed a for a predetermined time (operation 117). After completing the tumbling of the laundry, the controller 10 retrieves, from the speed mode storing unit 16, information about a second speed mode corresponding to the sensed laundry weight (operation 119). Based on the retrieved information about the second speed mode, the controller 10 drives the motor 7, thereby performing a secondary laundry wrapping process (operation 121). The second speed mode is divided into a plurality of sub-modes corresponding to respective speed ranges from the first speed a to the unbalance sensing speed b. The gradient of the motor speed in each of the sub-modes is set in accordance with the weight of the laundry so that the gradient of the motor speed is identical to or different from the gradient of the first speed mode.

During the secondary laundry wrapping process in the second speed mode, the controller 10 checks whether or not the motor speed sensed by the speed sensor 14 reaches the unbalance sensing speed b. When the sensed motor speed is determined to have reached the unbalance sensing speed b, the controller 10 again checks the unbalance condition of the rotating tub 2 by comparing the variation in the speed of the motor 7 with the reference speed variation (operation 123).

Based on a checked result at operation 123, the controller 10 determines whether or not the unbalance condition of the rotating tub 2 is sensed (operation 125). When no sensed unbalance condition of the rotating tub 2 is determined at operation 125, the controller 10 advances the routine to operation 129, and executes a main spin-dry process.

When the unbalance condition of the rotating tub 2 is determined to be sensed, the controller 10 stops the motor 7 (operation 127), and returns the routine to operation 105 to perform the above described primary and secondary laundry wrapping processes.

As is apparent from the above description, a speed gradient of a motor in a laundry wrapping process is set, depending on a weight of the laundry contained in a rotating tub. Accordingly, to sense an unbalance condition of the rotating tub under the condition in which the laundry in the rotating tub is in a uniformly wrapped state is possible. As a result, occurrence of the unbalance condition of the rotating tub is considerably reduced. Thus, to greatly reduce a time taken prior to a main spin-dry process is possible, while preventing abnormal vibrations from being generated when the rotating speed of the rotating tub reaches a speed at which resonance occurs.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A method of controlling a washing machine in which laundry contained in a rotating tub is spin-dried in accordance with a rotation of the rotating tub caused by driving of a motor connected to the rotating tub, the control method comprising:

sensing a weight of the laundry; and controlling a speed of the motor in accordance with the sensed weight of the laundry during the driving of the motor to sense an unbalance condition of the rotating tub, wherein the controlling of the speed of the motor is performed in a first speed mode, the first speed mode being set depending on the weight of the laundry, or in a second speed mode, the second speed mode being set depending on the information about the set first speed mode, the first and second speed modes, respectively, including information about one or more speed gradients to vary the speed of the motor, the information regarding at least one of the speed gradients of each of the modes differing from each other.

2. The control method according to claim 1, wherein the first speed mode is applied to the controlling of the speed of the motor.

3. The control method according to claim 1, wherein the first and second speed modes are alternately applied to the controlling of the speed of the motor.

4. The control method according to claim 1, wherein the second speed mode is divided into first and second sub-modes of different speed ranges to which identical or different motor speed gradients are, respectively, applied in accordance with the weight of the laundry.

* * * * *

UNITED STATES PATENT AND TRADEMARK OFFICE

CERTIFICATE OF CORRECTION

PATENT NO. : 7,412,740 B2
APPLICATION NO. : 10/895954
DATED : August 19, 2008
INVENTOR(S) : Chan Woo Park et al.

It is certified that error appears in the above-identified patent and that said Letters Patent is hereby corrected as shown below:

Title Page, Item (54) (Title), Lines 1-3, change "METHOD FOR CONTROLLING AND SENSING AN UNBALANCE CONDITION BASED ON SENSED LAUNDRY WEIGHT" to --WASHING MACHINE AND CONTROL METHOD THEREOF--.

Column 1 (Title), Lines 1-3, change "METHOD FOR CONTROLLING AND SENSING AN UNBALANCE CONDITION BASED ON SENSED LAUNDRY WEIGHT" to --WASHING MACHINE AND CONTROL METHOD THEREOF--.

Signed and Sealed this

Eleventh Day of November, 2008

JON W. DUDAS
*Director of the United States Patent and Trademark Office*